US005951723A

United States Patent [19]

Eberhard

[11] Patent Number: 5,951,723

[45] **Date of Patent: *Sep. 14, 1999**

[54] METHOD TO REMEDY ENGINE INTAKE VALVE STICKING

[75] Inventor: Gilles A. Eberhard, Rijswijk, Netherlands

[73] Assignee: Chevron Chemical Company, San Ramon, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/778,198

[22] Filed: Dec. 30, 1996

[51] Int. Cl.[6] ..... C01L 1/22

[52] U.S. Cl. ..... 44/387

[58] Field of Search ..... 44/387

[56] References Cited

U.S. PATENT DOCUMENTS

| | | | |
|---|---|---|---|
| 4,160,648 | 7/1979 | Lewis et al. | 44/63 |
| 4,191,537 | 3/1980 | Lewis et al. | 44/71 |
| 4,197,409 | 4/1980 | Lilburn | 560/158 |
| 4,233,168 | 11/1980 | Lewis et al. | 252/51.5 A |
| 4,236,020 | 11/1980 | Lewis et al. | 560/158 |
| 4,243,798 | 1/1981 | Franklin et al. | 528/371 |
| 4,270,930 | 6/1981 | Campbell et al. | 44/71 |
| 4,288,612 | 9/1981 | Lewis et al. | 560/159 |
| 4,881,945 | 11/1989 | Buckley, III | 44/72 |
| 5,336,278 | 8/1994 | Adams et al. | 44/419 |
| 5,522,906 | 6/1996 | Hashimoto et al. | 44/400 |

FOREIGN PATENT DOCUMENTS

| | | | |
|---|---|---|---|
| 0 534 551 | 3/1993 | European Pat. Off. | C01L 1/22 |

OTHER PUBLICATIONS

S. Mikkonen et al., "Intake Valve Sticking In Some Carburetor Engines" SAE Technical Paper Series 881643, Society of Automotive Engineers, U.S.A., Oct. 1988.

*Primary Examiner*—Ellen M. McAvoy
*Attorney, Agent, or Firm*—Claude J. Caroli

[57] ABSTRACT

A method to prevent intake valve sticking, or to reduce or eliminate intake valve sticking when it has already occurred, in an internal combustion engine which comprises contacting the engine intake valves with a fuel composition comprising a major amount of hydrocarbons boiling in the gasoline range and an amount effective to prevent, reduce or eliminate intake valve sticking of a hydrocarbyl poly (oxyalkylene) aminocarbamate having at least one basic nitrogen atom and an average molecular weight of about 500 to about 10,000, and wherein the hydrocarbyl group has from 1 to about 30 carbon atoms.

10 Claims, No Drawings

METHOD TO REMEDY ENGINE INTAKE VALVE STICKING

BACKGROUND OF THE INVENTION

The present invention relates to a method to remedy intake valve sticking in an internal combustion engine. More particularly, this invention relates to a method to remedy intake valve sticking utilizing a hydrocarbyl poly (oxyalkylene) aminocarbamate fuel additive.

It is well known that automobile engines tend to form deposits on the surface of engine components, such as carburetor ports, throttle bodies, fuel injectors, intake ports and intake valves, due to the oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants. Therefore, the development of effective fuel detergents or "deposit control" additives to prevent or control such deposits is of considerable importance and numerous such materials are known in the art.

However, it is also known that some detergent additives which remove carbonaceous engine deposits actually cause valve sticking, especially at low temperatures, when they work their way up the valve stem. See, for example, S. Mikkonen et al., "Intake Valve Sticking In Some Carburetor Engines", SAE Technical Paper Series 881643, Society of Automotive Engineers, Inc. U.S.A., 1988. According to this article, valve sticking did not occur in gasolines containing no detergent additives, but was observed at times when detergent additives were added to the same gasoline.

Poly(oxyalkylene) amines are also well known in the art as fuel additives for the prevention and control of engine deposits. For example, U.S. Pat. No. 4,191,537, issued Mar. 4, 1980 to R. A. Lewis et al., discloses a fuel composition comprising a major portion of hydrocarbons boiling in the gasoline range and from 30 to 2000 ppm of a hydrocarbyl poly(oxyalkylene) aminocarbamate having a molecular weight from about 600 to 10,000, and at least one basic nitrogen atom. The hydrocarbyl poly(oxyalkylene) moiety is composed of oxyalkylene units selected from 2 to 5 carbon oxyalkylene units. These fuel compositions are taught to maintain the cleanliness of intake systems without contributing to combustion chamber deposits.

Similar poly(oxyalkylene) amine fuel additives and fuel compositions containing such additives are described in U.S. Pat. Nos. 4,160,648; 4,236,020; and 4,288,612.

Moreover, U.S. Pat. No. 4,270,930, issued Jun. 2, 1981 to Campbell et al., discloses a fuel composition containing from 0.3 to 3 weight percent of a hydrocarbyl poly (oxyalkylene) aminocarbamate additive for use in keeping combustion chambers clean.

SUMMARY OF THE INVENTION

It has now been discovered that certain hydrocarbyl poly(oxyalkylene) aminocarbamates exhibit excellent performance in preventing, reducing or completely eliminating intake valve sticking, while maintaining good control of engine deposits, when employed as additives in fuel compositions.

Accordingly, the present invention provides a method to prevent intake valve sticking, or to reduce or eliminate intake valve sticking when it has already occurred, in an internal combustion engine which comprises contacting the engine intake valves with a fuel composition comprising a major amount of hydrocarbons boiling in the gasoline range and an amount effective to prevent, reduce or eliminate intake valve sticking of a hydrocarbyl poly(oxyalkylene) aminocarbamate having at least one basic nitrogen atom and an average molecular weight of about 500 to about 10,000, and wherein the hydrocarbyl group has from 1 to 30 carbon atoms.

Typically, the amount of hydrocarbyl poly(oxyalkylene) aminocarbamate present in the fuel composition will range from about 1,000 parts per million by weight to about 10,000 parts per million by weight, preferably from about 1,500 to about 5,000 parts per million, and more preferably from about 2,000 to about 4,000 parts per million.

In an alternative embodiment, the present invention relates to the use of about 1,000 to about 10,000 parts per million by weight based on the total composition of a hydrocarbyl poly(oxyalkylene) aminocarbamate as an additive for preventing, reducing or eliminating engine intake valve sticking in a fuel composition comprising a major amount of hydrocarbons boiling in the gasoline range, wherein the hydrocarbyl poly(oxyalkylene) aminocarbamate has at least one basic nitrogen atom and an average molecular weight of about 500 to about 10,000, and wherein the hydrocarbyl group has from 1 to about 30 carbon atoms.

Among other factors, the present invention is based on the surprising discovery that certain hydrocarbyl poly (oxyalkylene) aminocarbamates are highly effective in preventing intake valve sticking and in reducing or completely eliminating intake valve sticking in situations where it has already occurred.

DETAILED DESCRIPTION OF THE INVENTION

The hydrocarbyl poly(oxyalkylene) aminocarbamate employed in the present invention will contain at least one basic nitrogen atom and have an average molecular weight of about 500 to about 10,000. In addition, the hydrocarbyl substituent will contain from 1 to about 30 carbon atoms.

Generally, the hydrocarbyl poly(oxyalkylene) aminocarbamates suitable for use in the present invention will contain at least about 5 oxyalkylene units, preferably about 5 to 100, more preferably about 8 to 100, and even more preferably about 10 to 100. Especially preferred hydrocarbyl poly (oxyalkylene) aminocarbamates will contain about 10 to 25 oxyalkylene units.

In general, the hydrocarbyl poly(oxyalkylene) aminocarbamates employed in the present invention are the hydrocarbyl-substituted poly(oxyalkylene) aminocarbamates disclosed, for example, in U.S. Pat. Nos. 4,288,612; 4,236,020; 4,160,648; 4,191,537; 4,270,930; 4,233,168; 4,197,409; 4,243,798 and 4,881,945, the disclosure of each of which are incorporated herein by reference.

These hydrocarbyl poly(oxyalkylene) aminocarbamates contain at least one basic nitrogen atom and have an average molecular weight of about 500 to 10,000, preferably about 500 to 5,000, and more preferably about 1,000 to 3,000. As described more fully hereinbelow, these hydrocarbyl poly (oxyalkylene) aminocarbamates contain (a) a poly (oxyalkylene) moiety, (b) an amine moiety, and (c) a carbamate connecting group.

A. The Poly(oxyalkylene) Moiety

The hydrocarbyl-terminated poly(oxyalkylene) polymers which are utilized in preparing the hydrocarbyl poly (oxyalkylene) aminocarbamates employed in the present invention are monohydroxy compounds, e.g., alcohols, often termed monohydroxy polyethers, or polyalkylene glycol monocarbyl ethers, or "capped" poly(oxyalkylene) glycols, and are to be distinguished from the poly(oxyalkylene) glycols (diols), or polyols, which are not hydrocarbyl-terminated, i.e., are not capped. These hydrocarbyl poly (oxyalkylene) alcohols may be produced by the addition of lower alkylene oxides, such as ethylene oxide, propylene oxide, butylene oxide, etc. to a hydroxy compound, ROH, under polymerization conditions, wherein R is the hydrocarbyl group which caps the poly(oxyalkylene) chain.

In the hydrocarbyl poly(oxyalkylene) aminocarbamates employed in the present invention, the group R will generally contain from 1 to about 30 carbon atoms, preferably from 2 to about 20 carbon atoms and is preferably aliphatic or aromatic, i.e., an alkyl or alkyl phenyl wherein the alkyl is a straight- or branched-chain of from 1 to about 24 carbon atoms. More preferably, R is alkylphenyl wherein the alkyl group is a branched-chain of 12 carbon atoms, derived from propylene tetramer, and commonly referred to as tetrapropenyl.

The oxyalkylene units in the poly(oxyalkylene) moiety preferably contain from 2 to about 5 carbon atoms but one or more units of a larger carbon number may also be present. More preferably, the poly(oxyalkylene) moiety will be poly (oxypropylene) or poly(oxybutylene) or mixtures thereof, and most preferably, poly(oxybutylene). Generally, each poly(oxyalkylene) polymer contains at least about 5 oxyalkylene units, preferably about 5 to about 100 oxyalkylene units, more preferably about 8 to about 100 units, even more preferably about 10 to 100 units, and most preferably 10 to about 25 such units. The poly(oxyalkylene) moiety of the hydrocarbyl poly(oxyalkylene) aminocarbamates employed in the present invention is more fully described and exemplified in U.S. Pat. No. 4,191,537, issued Mar. 4, 1980 to Lewis, the disclosure of which is incorporated herein by reference.

B. The Amine Moiety

The amine moiety of the hydrocarbyl poly(oxyalkylene) aminocarbamate is preferably derived from a polyamine having from 2 to about 12 amine nitrogen atoms and from 2 to about 40 carbon atoms.

The polyamine is preferably reacted with a hydrocarbyl poly(oxyalkylene) chloroformate to produce the hydrocarbyl poly(oxyalkylene) aminocarbamate fuel additive finding use within the scope of the present invention. The chloroformate is itself derived from the hydrocarbyl poly (oxyalkylene) alcohol by reaction with phosgene.

The polyamine provides the hydrocarbyl poly (oxyalkylene) aminocarbamate with, on the average, at least about one basic nitrogen atom per carbamate molecule, i.e., a nitrogen atom titratable by strong acid. The polyamine preferably has a carbon-to-nitrogen ratio of from about 1:1 to about 10:1. The polyamine may be substituted with substituents selected from hydrogen, hydrocarbyl groups of from 1 to about 10 carbon atoms, acyl groups of from 2 to about 10 carbon atoms, and monoketone, monohydroxy, mononitro, monocyano, alkyl and alkoxy derivatives of hydrocarbyl groups of from 1 to 10 carbon atoms. It is preferred that at least one of the basic nitrogen atoms of the polyamine is a primary or secondary amino nitrogen. The amine moiety of the hydrocarbyl poly(oxyalkylene) aminocarbamates employed in the present invention has been described and exemplified more fully in U.S. Pat. No. 4,191,537.

A more preferred polyamine for use in preparing the hydrocarbyl poly(oxyalkylene) aminocarbamates finding use within the scope of the present invention is a polyalkylene polyamine, including alkylenediamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Examples of such polyamines include ethylenediamine, diethylenetriamine, triethylenetetramine, di(trimethylene)triamine, dipropylenetriamine, tetraethylenepentamine, etc.

Among the polyalkylene polyamines, polyethylene polyamine and polypropylene polyamine containing 2 to about 12 amine nitrogen atoms and 2 to about 24 carbon atoms are especially preferred and in particular, the lower polyalkylene polyamines, e.g., ethylenediamine, diethylenetriamine, propylenediamine, dipropylenetriamine, etc., are most preferred.

C. The Aminocarbamate Connecting Group

The hydrocarbyl poly(oxyalkylene) aminocarbamate employed in the present invention is obtained by linking the polyamine and the hydrocarbyl poly(oxyalkylene) alcohol together through a carbamate linkage, i.e.,

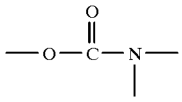

wherein the oxygen may be regarded as the terminal hydroxyl oxygen of the poly(oxyalkylene) alcohol, the nitrogen is derived from the polyamine, and the carbonyl group, —C(O)—, is preferably provided by a coupling agent, such as phosgene.

In a preferred method of preparation, the hydrocarbyl poly(oxyalkylene) alcohol is reacted with phosgene to produce a chloroformate and the chloroformate is reacted with the polyamine. Since there may be more than one nitrogen atom of the polyamine which is capable of reacting with the chloroformate, the carbamate product may contain more than one hydrocarbyl poly(oxyalkylene) moiety. It is preferred that the hydrocarbyl poly(oxyalkylene) aminocarbamate product contains on the average, about one poly (oxyalkylene) moiety per molecule (i.e., is a monocarbamate), although it is understood that this reaction route may lead to mixtures containing appreciable amounts of di- or higher poly(oxyalkylene) chain substitution on a polyamine containing several reactive nitrogen atoms.

A particularly preferred aminocarbamate is alkylphenyl poly(oxybutylene) aminocarbamate, wherein the amine moiety is derived from ethylene diamine or diethylene triamine. Synthetic methods to avoid higher degrees of substitution, methods of preparation, and other characteristics of the aminocarbamates used in the present invention are more fully described and exemplified in U.S. Pat. No. 4,191,537.

Fuel Compositions

The hydrocarbyl poly(oxyalkylene) aminocarbamate fuel additive used in the present invention will generally be employed in hydrocarbon fuels to prevent, reduce or eliminate intake valve sticking. The proper concentration of the additive composition necessary to achieve the desired remediation of valve sticking varies depending upon the type of fuel employed, the type of engine, and the presence of other fuel additives.

Generally, the hydrocarbyl poly(oxyalkylene) aminocarbamate will be employed in hydrocarbon fuels in a concentration ranging from about 1,000 to about 10,000 parts per million (ppm) by weight (0.1 to 1 weight percent), preferably from about 1,500 to about 5,000 ppm (0.15 to 0.5 weight percent), and more preferably from about 2,000 to about 4,000 ppm (0.2 to 0.4 weight percent).

In one preferred embodiment, the hydrocarbyl poly (oxyalkylene) aminocarbamate will be employed in a concentration of greater than about 2,000 ppm (0.2 weight percent) to below about 3,000 ppm (0.3 weight percent), more preferably from about 2,100 ppm to about 2,900 ppm (0.21 to 0.29 weight percent), even more preferably from about 2,200 ppm to about 2,800 ppm, even more preferably from about 2,300 ppm to about 2,700 ppm, and even more preferably from about 2,400 ppm to about 2,600 ppm.

The hydrocarbyl poly(oxyalkylene) aminocarbamate may be formulated as a concentrate using an inert stable oleophilic (i.e., dissolves in gasoline) organic solvent boiling in the range of about 150° F. to 400° F. (about 65° C. to 205° C.). Preferably, an aliphatic or an aromatic hydrocarbon solvent is used, such as benzene, toluene, xylene or higher-boiling aromatics or aromatic thinners. Aliphatic alcohols containing about 3 to 8 carbon atoms, such as isopropanol, isobutylcarbinol, n-butanol and the like, in combination with hydrocarbon solvents are also suitable for use with the presently employed additives. In the concentrate, the amount of the additive will generally range from about 10 to about 70 weight percent, preferably 10 to 50 weight percent, more preferably from 20 to 40 weight percent.

In gasoline fuels, other fuel additives may be employed with the hydrocarbyl poly(oxyalkylene) aminocarbamates, including, for example, oxygenates, such as t-butyl methyl ether, antiknock agents, such as methylcyclopentadienyl manganese tricarbonyl, and other dispersants/detergents, such as hydrocarbyl amines or succinimides. Additionally, antioxidants, metal deactivators and demulsifiers may be present.

A fuel-soluble, nonvolatile carrier fluid or oil may also be used with the hydrocarbyl poly(oxyalkylene) aminocarbamate fuel additive. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic oil, such as mineral oil, refined petroleum oils, synthetic polyalkanes and alkenes, including hydrogenated and unhydrogenated polyalphaolefins, and synthetic poly(oxyalkylene)-derived oils, such as those described, for example, in U.S. Pat. No. 4,191,537 to Lewis.

The carrier fluids are typically employed in amounts ranging from about 100 to about 10,000 ppm by weight of the hydrocarbon fuel. Preferably, the ratio of carrier fluid to fuel additive will range from about 0.1:1 to about 10:1.

When employed in a fuel concentrate, carrier fluids will generally be present in amounts ranging from about 10 to about 90 weight percent.

EXAMPLES

The following examples are presented to illustrate specific embodiments of the present invention and synthetic preparations thereof; and should not be interpreted as limitations upon the scope of the invention.

Example B1

An engine test was carried out using a CEC legislative fuel RF-08-A-85, an industry reference fuel, to evaluate its tendency to cause inlet valve sticking. The test engine was a 4-cylinder, water cooled boxer VW engine, model DF. The main specifications for this VW Wasserboxer engine are shown in Table 1.

TABLE 1

| Engine specifications | |
|---|---|
| Bore | 94 mm |
| Stroke | 69 mm |
| Displacement | 1.9 liter |
| Maximum power | 44 kW @ 3700 rpm |

The test procedure consists of subsequent test runs of 20.5 hours. Each run consists of 13 test cycles of 21 minutes each, a cold soak period, and compression tests. A test cycle consists of 3 stages as shown in Table 2. After each 13 cycles, the engine is stopped and cooled down to 5° C. within 60 minutes and the engine is maintained at 5° C. for a further 15 hours.

TABLE 2

| Test cycle | | | | |
|---|---|---|---|---|
| Stage | Time in Stage (minutes) | Engine Speed (RPM) | Engine Load (kW) | Absolute Inlet Manifold Pressure (mbar) |
| 1 | 6 | 1700 | 5 | 415 |
| 2 | 5 | 2000 | 7.5 | 450 |
| 3 | 10 | engine off, standstill | | — |

At the end of this cold soak period, compression pressures are measured of all four cylinders. If the compression pressure of a cylinder is less than 8.0 bar, then inlet valve sticking is considered to occur.

Example B2

A sample fuel composition B2 was prepared by adding:

(1) 219 ppma (parts per million actives) by weight of a polyisobutenyl (molecular weight about 1300) succinimide; and (2) 308 ppm by weight of a mineral carrier oil of a 500 solvent neutral type to the gasoline of Example B1.

The same experiment as in Example B1 was carried out using this fuel composition. Two test runs were carried out, and the results are shown in Table 3 below.

Example B3

A sample fuel composition B3 was prepared by adding:

(1) 2910 ppma by weight of a dodecylphenyl poly (oxybutylene) ethylene diamine carbamate (molecular weight about 1600), prepared essentially as described in Examples 6–8 of U.S. Pat. No. 4,191,537, to the fuel composition of Example B2.

The experiment as in Example B2 was continued by replacing fuel composition B2 with fuel composition B3, and a further two test runs were carried out. The results are shown in Table 3 below.

Example B4

The experiment of Example B2 was repeated, and the results are shown in Table 3 below as fuel composition B4.

Example B5

A sample fuel composition B5 was prepared by adding:

(1) 2910 ppma by weight of dodecylphenyl poly (oxybutylene) ethylene diamine carbamate (molecular weight about 1600) to the gasoline of Example B1.

The experiment as in Example B4 was continued by replacing fuel composition B4 with fuel composition B5, and a further two test runs were carried out. The results are shown in Table 3 below.

TABLE 3

VW Wasserboxer Engine Test Results

| | Test run 1 | Test run 2 | Test run 3 | Test run 4 |
|---|---|---|---|---|
| | Number of sticking valves | | | |
| Fuel composition B2 | 4 | 4 | — | — |
| Fuel composition B3 | — | — | 0 | 0 |
| Fuel composition B4 | 4 | 4 | — | — |
| Fuel composition B5 | — | — | 0 | 0 |

The results in Table 3 illustrate that the fuel compositions B3 and B5 have effectively eliminated any valve sticking as caused by fuel compositions B2 and B4, respectively.

What is claimed is:

1. A method to prevent intake valve sticking, or to reduce or eliminate intake valve sticking when it has already occurred, in an internal combustion engine which comprises contacting the engine intake valves with a fuel composition comprising a major amount of hydrocarbons boiling in the gasoline range and an amount greater than about 2,000 to below about 3,000 parts per million by weight of a hydrocarbyl poly(oxyalkylene) aminocarbamate having at least one basic nitrogen atom and an average molecular weight of about 500 to about 10,000, and wherein the hydrocarbyl group has from 1 to about 30 carbon atoms.

2. The method according to claim 1, wherein said hydrocarbyl group of said hydrocarbyl poly(oxyalkylene) aminocarbamate is an alkylphenyl group.

3. The method according to claim 2, wherein the alkyl moiety of said alkylphenyl group is tetrapropenyl.

4. The method according to claim 1, wherein the amine moiety of said hydrocarbyl poly(oxyalkylene) aminocarbamate is derived from a polyamine having from 2 to 12 amine nitrogen atoms and from 2 to 40 carbon atoms.

5. The method according to claim 4, wherein said polyamine is a polyalkylene polyamine having 2 to 12 amine nitrogen atoms and 2 to 24 carbon atoms.

6. The method according to claim 5, wherein said polyalkylene polyamine is selected from the group consisting of ethylenediamine, propylenediamine, diethylenetriamine and dipropylenetriamine.

7. The method according to claim 1, wherein the poly (oxyalkylene) moiety of said hydrocarbyl poly(oxyalkylene) aminocarbamate is derived from $C_2$ to $C_5$ oxyalkylene units.

8. The method according to claim 7, wherein the poly (oxyalkylene) moiety is poly(oxybutylene).

9. The method according to claim 1, wherein said hydrocarbyl poly(oxyalkylene) aminocarbamate is an alkylphenyl poly(oxybutylene) aminocarbamate, wherein the amine moiety is derived from ethylenediamine or diethylenetriamine.

10. The method according to claim 1, wherein the fuel composition contains about 2,100 to about 2,900 parts per million by weight of the hydrocarbyl poly(oxyalkylene) aminocarbamate.

* * * * *